US010903581B2

(12) United States Patent
Zhao et al.

(10) Patent No.: US 10,903,581 B2
(45) Date of Patent: Jan. 26, 2021

(54) FIXING STRUCTURE TO ENHANCE THE MECHANICAL RELIABILITY OF PLATE SLOT ARRAY ANTENNA BASED ON SIW TECHNOLOGY

(71) Applicant: Honeywell International Inc., Morris Plains, NJ (US)

(72) Inventors: Weihong Zhao, Shanghai (CN); Nigel Wang, Shanghai (CN); Rajesh Chivukula, Bangalore (IN)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 16/453,902

(22) Filed: Jun. 26, 2019

(65) Prior Publication Data

US 2020/0412012 A1 Dec. 31, 2020

(51) Int. Cl.

| | |
|---|---|
| ***H01Q 13/10*** | (2006.01) |
| ***H01Q 21/00*** | (2006.01) |
| ***H01Q 13/22*** | (2006.01) |

(52) U.S. Cl.

CPC ..... *H01Q 21/005* (2013.01); *H01Q 13/22* (2013.01)

(58) Field of Classification Search

CPC ..... H01Q 21/005; H01Q 13/22

See application file for complete search history.

(56) References Cited

U.S. PATENT DOCUMENTS

| | | | | |
|---|---|---|---|---|
| 7,808,439 | B2 | 10/2010 | Yang et al. | |
| 2010/0321265 | A1* | 12/2010 | Yamaguchi | H01Q 21/0043 343/771 |

FOREIGN PATENT DOCUMENTS

| | | | |
|---|---|---|---|
| CN | 103367915 | A | 10/2013 |
| CN | 105186141 | A | 12/2015 |
| EP | 2267841 | A1 | 12/2010 |
| EP | 3276376 | A1 | 1/2018 |
| EP | 3451452 | A1 | 3/2019 |
| JP | S59139707 | A | 10/1984 |

(Continued)

OTHER PUBLICATIONS

Bakhtafrouz et al., "Compact Two-Layer Slot Array Antenna with SIW for 60GHz Wireless Applications," IEEE Antennas and Propagation Society International Symposium, Jul. 24, 2009, 4 pp.

(Continued)

*Primary Examiner* — Dieu Hien T Duong

(74) *Attorney, Agent, or Firm* — Shumaker & Sieffert, P.A.

(57) ABSTRACT

This disclosure is directed to techniques to improve the mechanical reliability and strength of slot array antennae created using printed circuit board (PCB) technology. In some examples, a multi-layer PCB may have a limit on the length and width dimensions. Therefore, a larger slot array antenna may require two or more PCBs to create the full size of the antenna. This disclosure describes techniques to securely connect the two or more PCBs to withstand environments where the slot array antenna may be placed under mechanical stress, such as vibration. A PCB based antenna may define the walls of radiating waveguides with vias between the layers of the PCB. Mechanical fasteners may pass through some of the existing vias to secure the PCB to a support structure, such as a feeding waveguide, as well as to secure one PCB to other PCBs.

11 Claims, 6 Drawing Sheets

(56) References Cited

FOREIGN PATENT DOCUMENTS

| | | | |
|---|---|---|---|
| WO | 2018/137545 | A1 | 8/2018 |
| WO | 2018/146369 | A1 | 8/2018 |

OTHER PUBLICATIONS

Extended Search Report from counterpart European Application No. 20181770.7, dated Oct. 26, 2020, 12 pp.
Response to Extended Search Report dated Oct. 26, 2020, from counterpart European Application No. 20181770.7 filed Nov. 25, 2020, 33 pp.

* cited by examiner

FIXING STRUCTURE TO ENHANCE THE MECHANICAL RELIABILITY OF PLATE SLOT ARRAY ANTENNA BASED ON SIW TECHNOLOGY

TECHNICAL FIELD

The disclosure relates slot array antennae.

BACKGROUND

Plated slot array antennae may use printed circuit board (PCB) technology to create features of an antenna. For example, a substrate integrated waveguide (SIW) slot array antenna may use PCB technology to accurately place the radiating slots, vias, coupling slots and other features. By using PCB technology, a slot array antenna may be very accurate at a significant cost and weight savings when compared to a machined aluminum antenna.

SUMMARY

In general, the disclosure is directed to techniques to improve the mechanical reliability and strength of slot array antennae created using printed circuit board (PCB) technology. In some examples, a multi-layer PCB may have a limit on the length and width dimensions. Therefore, a larger slot array antenna may require two or more PCBs to create the full size of the antenna. The techniques of this disclosure describe techniques to securely connect the two or more PCBs to withstand environments where the slot array antenna may be placed under mechanical stress, such as vibration, impact, and large temperature transitions. The techniques of this disclosure further provide techniques to securely attach the PCB portion of the slot array antenna to a support structure, such as a feeding waveguide that may couple radio-frequency (RF) radiation between transmit and receive electronics and the slot array antenna.

The PCB based slot waveguide antenna of this disclosure may define the walls of the radiating waveguides with vias between the layers of the multi-layer PCB. The techniques of this disclosure may include mechanical fasteners that pass through some of the existing vias to secure the PCB to the support structure, such as a feeding waveguide, as well as to secure one PCB to other PCBs that form the slot waveguide antenna.

In one example, the disclosure is directed to a slotted array antenna device, the device comprising: a radiating slot plane comprising a radiating slot array including a plurality of radiating slots, a radiating waveguide comprising: a plurality of vias arranged to form the radiating waveguide; and a coupling slot. The coupling slot is arranged in a coupling slot layer on an opposite side of the device from the radiating slot plane, and the radiating waveguide is configured to conduct radio frequency (RF) energy between the coupling slot and the one or more of the radiating slots of the radiating slot array. The antenna may also include a feed waveguide, wherein: the feed waveguide is configured to conduct RF energy to the coupling slot, the feed waveguide is configured to provide structural support to the device and a plurality of pins, wherein each pin of the plurality of pins: passes through a via of the plurality of vias; passes through the feed waveguide; mechanically secures the feed waveguide to the coupling slot layer of the device.

In another example, the disclosure is directed to weather radar system comprising an integrated radar antenna, the integrated radar antenna comprising a multi-layer circuit board, the multi-layer circuit board comprising: radar transmitter electronics in signal communication with the slotted array waveguide antenna, wherein the radar transmit electronics, in conjunction with the slotted array waveguide antenna, are configured to output radar signals; radar receiver electronics in signal communication with the slotted array waveguide antenna, wherein the radar receiver electronics are configured to receive from the slotted array waveguide antenna radar reflections corresponding to the outputted radar signals. The weather radar system may also include a slotted array waveguide antenna, comprising: a radiating slot plane comprising a radiating slot array including a plurality of radiating slots; a radiating waveguide comprising: a plurality of vias arranged to form the radiating waveguide; and a coupling slot, wherein the coupling slot is arranged in a coupling slot layer on an opposite side of the device from the radiating slot plane, wherein the radiating waveguide is configured to conduct radio frequency (RF) energy from the coupling slot to one or more of the radiating slots of the radiating slot array; a support structure, configured to provide structural support to the device wherein: a plurality of pins, wherein each pin of the plurality of pins: passes through a via of the plurality of vias; passes through the support structure, and mechanically secures the support structure to the integrated radar antenna.

The details of one or more examples of the disclosure are set forth in the accompanying drawings and the description below. Other features, objects, and advantages of the disclosure will be apparent from the description and drawings, and from the claims.

DETAILED DESCRIPTION

The size of a slot array antenna, such as a slot integrated waveguide antenna (SIW), created using printed circuit board (PCB) technology may be limited by size limits of a multi-layer PCB. In some examples, two or more PCBs may need to be assembled to create a single slot array antenna of the desired size. Also, PCB based slot array antennae may be coupled to a support structure, such as a feeding waveguide, which may be configured to conduct RF energy between the slot array antenna and the radar transmit and receive electronics. In the example of a feeding waveguide, the slot array antenna and feeding waveguide may be coupled by solder, for example, to ensure both a mechanical and an electrical connection. In applications that involve mechanical stress, such as vibration or large changes in temperature, maintaining antenna flatness and a solid mechanical connection between the one or more PCBs and between the PCBs and the support structure may be a challenge.

The techniques of this disclosure may improve the mechanical reliability and strength of slot array antennae created using printed circuit board (PCB) technology. This disclosure describes techniques for securely connecting the two or more PCBs together into a single slot array antenna such that the antenna may withstand environments where the slot array antenna may be placed under mechanical stress. This disclosure also describes techniques for securely attaching the PCB portion of the slot array antenna to a support structure, such as a feeding waveguide. The techniques of this disclosure may take advantage of the existing vias that define the walls of the radiating waveguides and include mechanical fasteners that pass through some of the existing vias to secure the PCB to the support structure, such as a feeding waveguide, as well as to secure one PCB to other PCBs that form the slot waveguide antenna. In this way, the techniques of this disclosure may enhance the reliability of a PCB based slot array antenna and keep the performance stable over time.

Figure 1A:
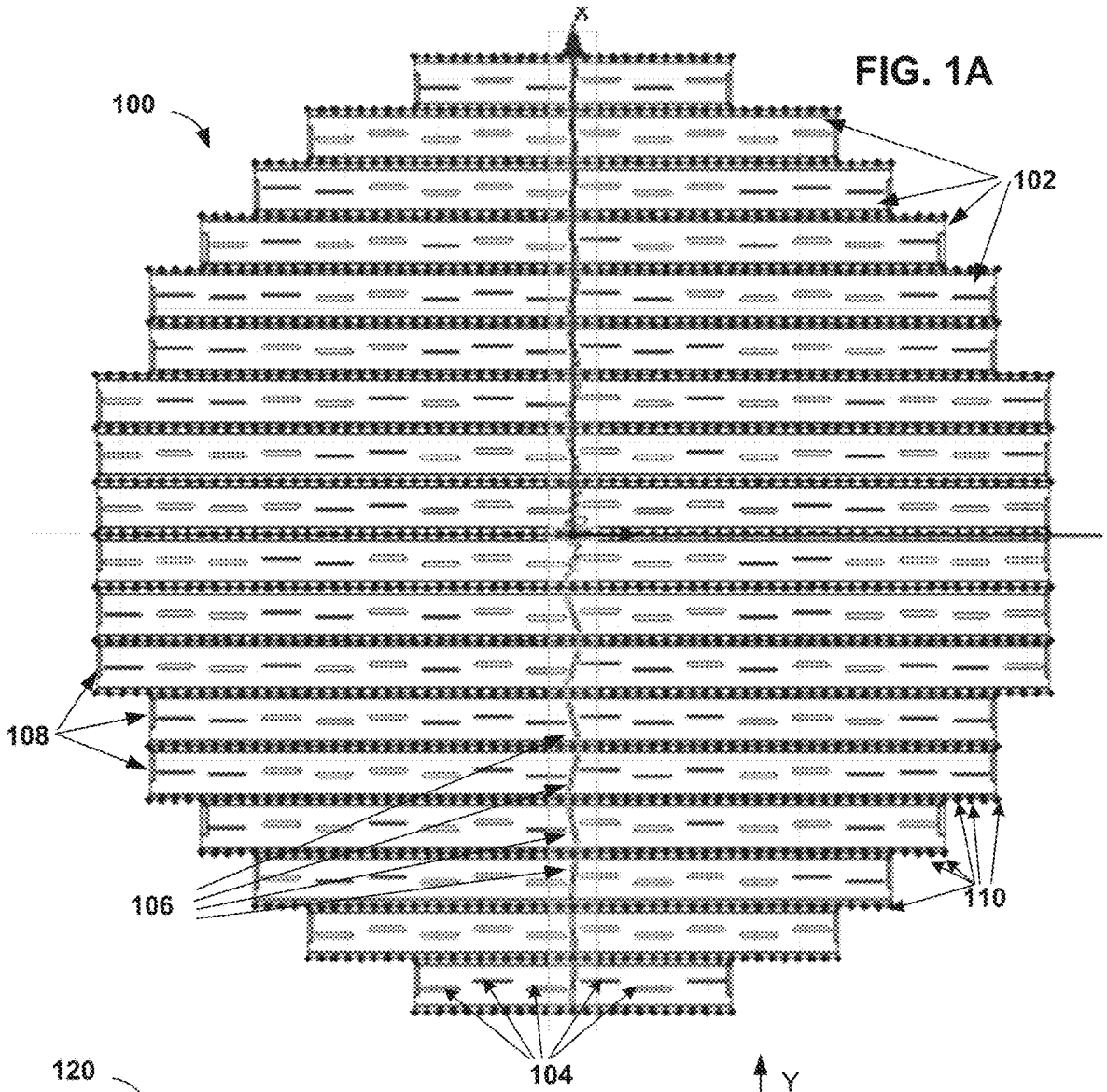
FIGS. 1A and 1B are conceptual diagrams illustrating a slot array antenna created using PCB technology.
Figure 1B:
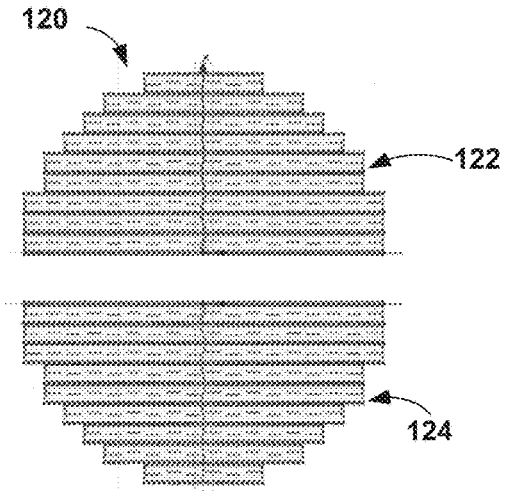

FIGS. 1A and 1B are conceptual diagrams illustrating a slot array antenna created using PCB technology. The example slot array antenna 100 of FIG. 1A may be used as a weather radar antenna. In other examples, other shapes for a slot array antenna may be used for other applications. In the example of a weather radar antenna mounted on an aircraft, slot array antenna 100 (antenna 100 for short) may be subject to wide temperature changes from high temperatures greater than 40° C. (~100° F.) during ground operations to less than −40° C. (−40° F.) when operating at higher altitudes. Antenna 100 may also be subject to other sources of mechanical stress such as vibration from turbulence, shock during landing, and centrifugal force during maneuvering.

Antenna 100 may include radiating waveguides 102, radiating slots 104, and coupling slots 106. As described above, the features of antenna 100, such as radiating slots 104 and coupling slots 106 may be formed using the same PCB techniques used to create a multi-layer circuit board.

Antenna 100 may include a radiating slot plane that includes radiating slots 104 in a conductive plated material to form a radiating plane. Radiating slots 104 are configured to radiate RF energy from radiating waveguides 102 and to receive the reflected RF energy. RF energy may be reflected from liquid in the atmosphere, other vehicles such as aircraft, terrain and other features. The arrangement of radiating slots 104, e.g. the length and width of each radiating slot, the offset of each slot from the centerline and walls of radiating waveguides 102 and other dimensions may shape the transmit beam and sidelobes of the transmitted RF energy.

The dimensions of radiating waveguides 102 may be defined by vias 110, which may also be formed using PCB techniques. Vias 110 may electrically connect the conductive surface of the radiating slot plane to the conducting slot plane. Vias 110 define the walls of radiating waveguides 102. The spacing and diameter of vias 110 may depend on the RF frequencies used by antenna 100. In some examples, radiating waveguides 102 may be substrate integrated waveguides (SIW) in which the RF energy travels through the PCB substrate material. In other examples, radiating waveguides 102 may be formed by electrically conductive surfaces and the RF energy may travel through a gas, such as air.

Radiating waveguides 102 are configured to conduct RF energy between coupling slots 106 and the radiating slots 104 of the radiating slot array. In the example of FIGS. 1A and 1B, the line of coupling slots 106 are shown in the Y-direction and the radiating waveguides, along with vias 110, are shown in the X-direction. Antenna 100 is shown in a see-through view in the examples of FIGS. 1A and 1B to simplify the explanation of antenna 100. However, coupling slots 106 are arranged in a coupling slot layer on an opposite side of antenna 100 from the radiating slot plane containing radiating slots 104. The dimensions and offset angle from the Y-axis for coupling slots 106 may vary depending on the position of the coupling slot in antenna 100.

In some examples, radiating waveguides 102 may include a termination edge 108. Termination edge 108 may be a conductive material that may be electrically connected to, for example, the radiating slot plane, the conducting slot plane and thereby to vias 110. Termination edge 18 may contain and direct the RF energy in radiating waveguides 102.

FIG. 1B is a conceptual diagram illustrating an example slot array antenna formed by two separate PCBs. Antenna 120 depicted in FIG. 1B is an example of antenna 100 described above in relation to FIG. 1A.

In the example of FIG. 1B, antenna 120 is formed by PCB 122 and PCB 124. PCB 122 includes a first radiating slot plane and PCB 124 includes a second radiating slot plane. PCB 122 includes a first coupling slot layer and PCB 124 includes a second coupling slot layer. PCB 122 includes a first radiating waveguide section and PCB 124 includes a second radiating waveguide section. When PCB 122 and PCB 124 are electrically and mechanically attached, then PCB 122 and PCB 124 form a single slot array antenna 120. In other examples, slot array antenna 120 may be formed by three, four or more PCBs and electrically and mechanically connected as described herein.

The mechanical fasteners of this disclosure may include advantages over other techniques. For example, using solder or a conductive adhesive without additional mechanical fasteners to secure the feeding waveguide to the antenna may eventually result in voids or cracks in the adhesive or solder. Voids or cracks may result in RF energy leakage and reduced antenna performance. Also, the mechanical fasteners of this disclosure may be less expensive than other mechanical fastening techniques. Moreover, passing the mechanical fasteners through existing vias may provide the additional mechanical strength without impacting the antenna performance.

Figure 2A:
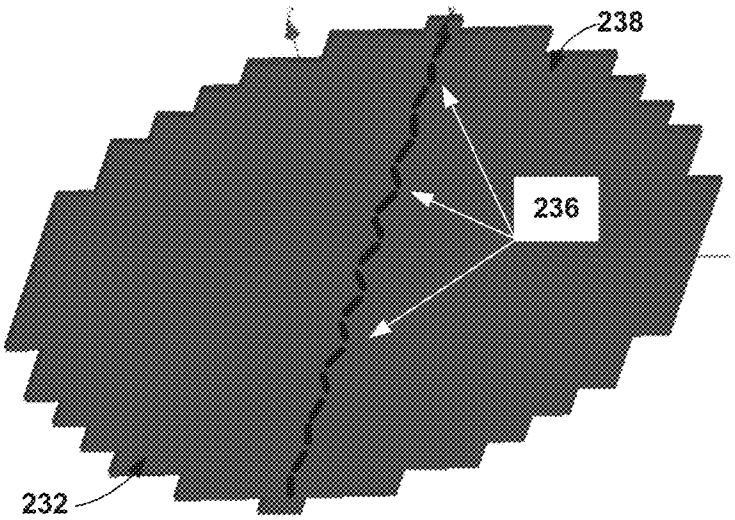
FIG. 2A is a diagram illustrating an isometric view of a coupling slot plane of the radiating portion of a radar antenna according to one or more techniques of this disclosure.

FIG. 2A is a diagram illustrating an isometric view of a coupling slot plane of the radiating portion of a radar antenna according to one or more techniques of this disclosure. FIG. 2A depicts coupling slot plane 232 with coupling slots 236. In the example of a radiating waveguide that conducts RF energy via a gas, coupling slots 236 may be include in in outer plated layer 238. Coupling slots 236 are examples of coupling slots 106 described above in relation to FIG. 1A.

Figure 2B:
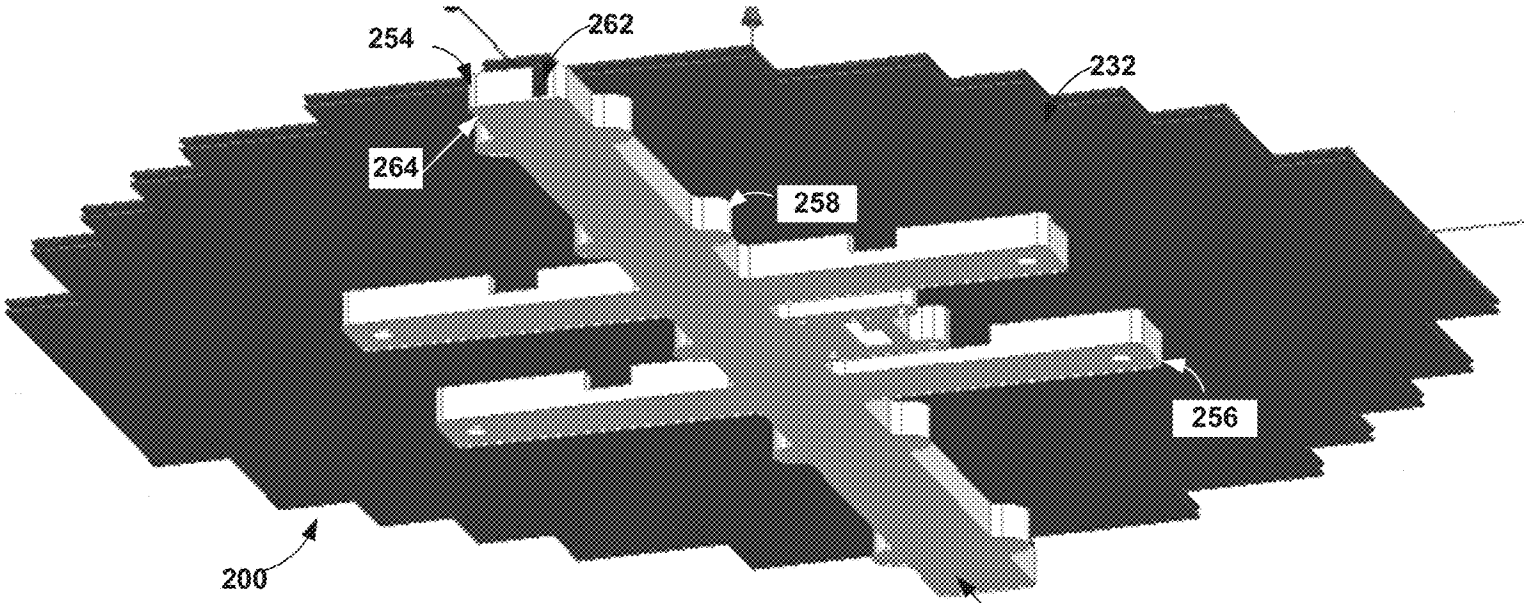
FIG. 2B is a diagram illustrating an assembly view of an example portion of a slot array antenna including a radiated portion and a feed portion.

FIG. 2B is a diagram illustrating an assembly view of an example portion of a slot array antenna including a radiated portion and a feed portion. Feed portion 254 is a supporting structure configured to support antenna 200 as well as conduct RF energy to and from coupling slots 236 (not shown in FIG. 2B). Antenna 200 is an example of antennae 100 and 120 described above in relation to FIGS. 1A and 1B.

In the example of FIG. 2B, feed portion 254 includes feed waveguide 250. Feed portion 254 may also include one or more additional support structures 256 and one or more positioning structures 258. Feed portion 254 of the antenna of this disclosure may include a metallic coupling feed waveguide 250, which may be also be referred to as a pedestal, a driving waveguide or a feeding waveguide. Feed waveguide 250 may be configured to carry the RF energy between the RF generating components of, for example a radar system, and each branch of radiating waveguides 102 of the antenna, described above in relation to FIG. 1B (not shown in FIG. 2B).

Feed waveguide 250 may be machined from aluminum, or other similar material and bonded to the radiating portion. Feed waveguide 250 may be bonded to coupling slot plane 232 by a variety of methods that may ensure good connection. RF manufacturing techniques to connect feed waveguide 250 to the radiating portion in an accurate position may be desirable to reduce RF energy leakage, mismatching and insertion loss. Some examples of bonding techniques may include soldering, such as with tin, as well as silver epoxy or other conductive adhesive. In some examples, the aluminum portions of the antenna assembly may be plated with nickel to improve the soldering connection. In some examples, a fixture may be developed to press the components together to ensure even weight distribution during assembly.

In some examples positioning studs or other protrusions may be formed in feed waveguide 250 to align with holes, such as via holes, in the PCB portions of coupling slot plane 232 for accurate positioning. In some examples feed waveguide 250 may include a termination edge 264 that may only partially enclose the end of the conducting path of feed waveguide 250, leaving an opening 262. The size of opening 262 may depend on the operating frequency of the antenna. In some examples, opening 262 left by termination edge 264 that partially covers the end of the conducting path may be desirable to release humidity, condensed moisture or particles, such as dust, that may enter the conducting path of feed waveguide 250.

Antenna 200 may also include a plurality of pins, or other mechanical fasteners (not shown in FIG. 2B) that pass through an existing via, such as vias 110 described above in relation to FIG. 1A. The mechanical fasteners may pass through some of the vias and pass through feed waveguide 250. The mechanical fasteners may mechanically secure the feed waveguide to the coupling slot layer 232 of antenna 200. As described above, feed waveguide 250 may also be soldered, or otherwise mechanically and electrically connected to coupling slot plane 232.

Figure 3A:
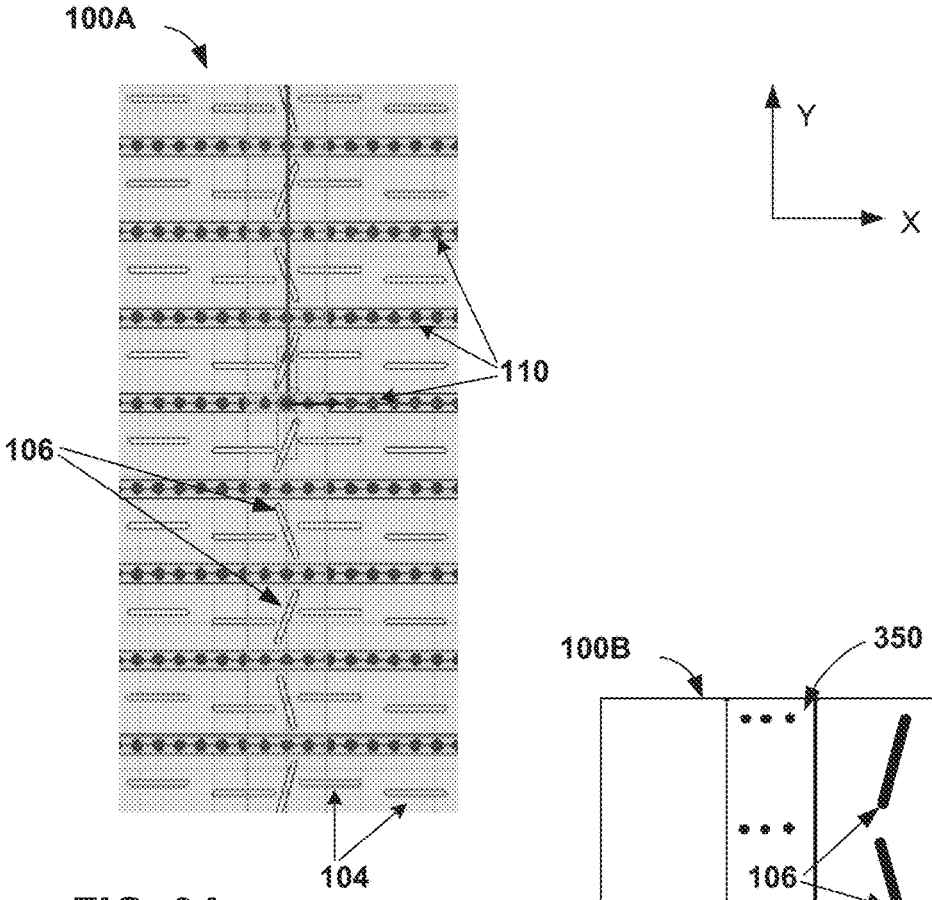
FIGS. 3A-3C are conceptual diagrams illustrating examples of a slotted array antenna that includes fasteners securing a feed waveguide to the radiating portion of the slotted array antenna.
Figure 3B:
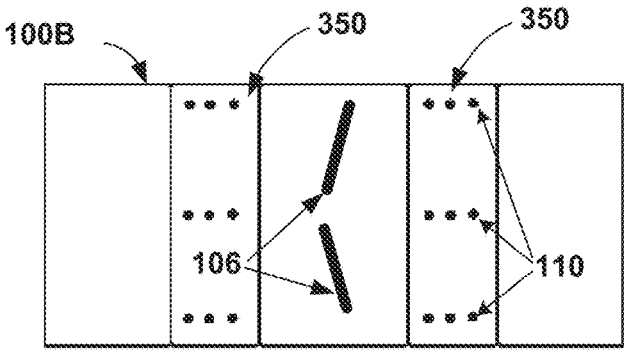
Figure 3C:
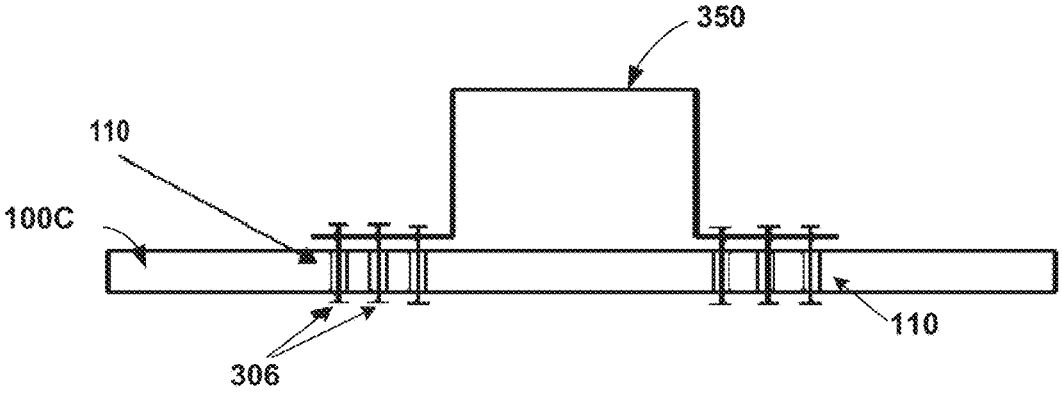

FIGS. 3A-3C are conceptual diagrams illustrating examples of a slotted array antenna that includes fasteners securing a feed waveguide to the radiating portion of the slotted array antenna. Antennae 100A-100C depict portions of antenna 100 and 200 described above in relation to FIGS. 1A and 2B.

Antenna 100A in the top-view example of FIG. 3A depicts radiating slots 104 and vias 110 that are shown arranged in the X-direction. Coupling slots 106 are arranged in the Y-direction.

FIG. 3B depicts a top-view of antenna 100B with a portion of feed waveguide 350 arranged in the Y-direction such that feed waveguide 350 is arranged to cover coupling slots 106. Antenna 100B also includes mechanical fasteners that pass through existing vias 110 to mechanically connect waveguide 350 to antenna 100B.

FIG. 3C depicts a side cutaway view of antenna 100C and waveguide 350. Mechanical fasteners 306, such as pins, pass through existing vias 110 to secure waveguide 350 to antenna 100C.

Figure 4A:
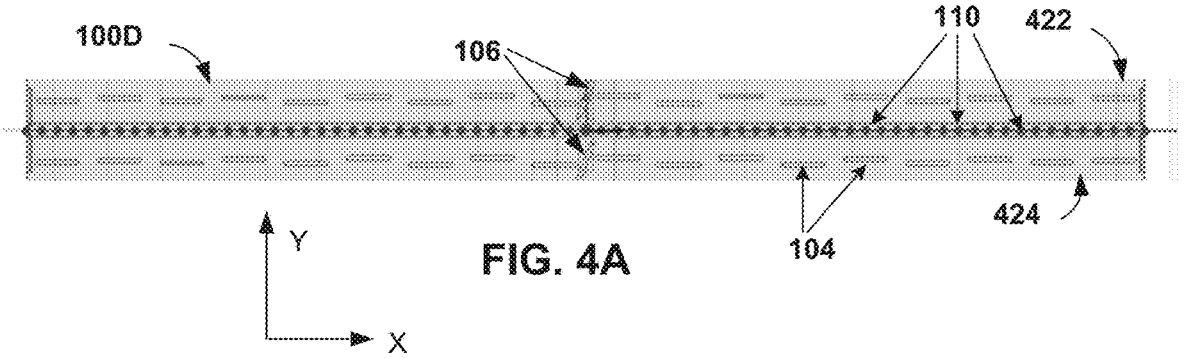
FIGS. 4A-4C are conceptual diagrams illustrating example techniques to mechanically secure a first PCB to a second PCB in according to one or more techniques of this disclosure.
Figure 4B:
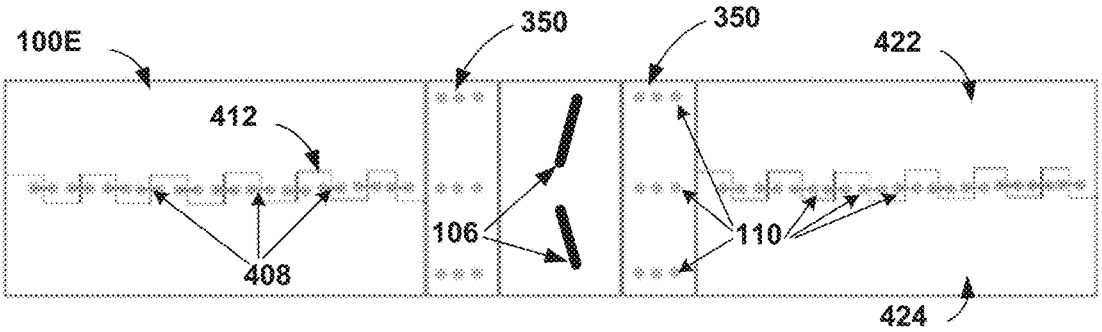
Figure 4C:
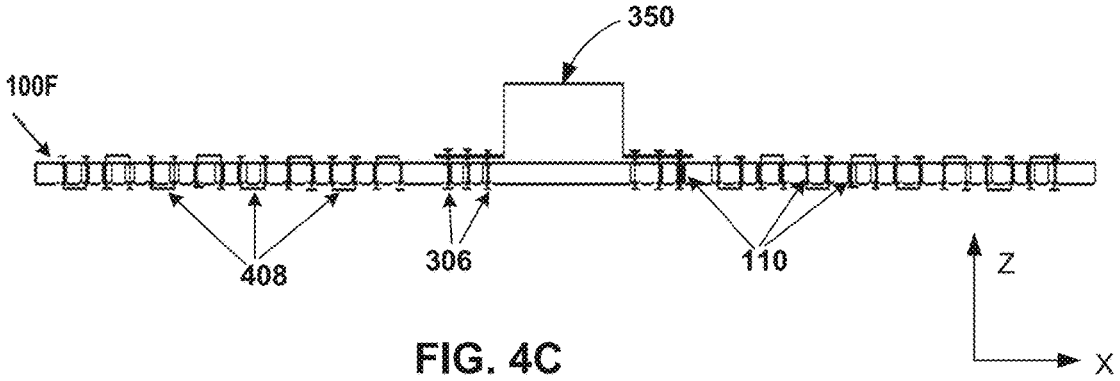

FIGS. 4A-4C are conceptual diagrams illustrating example techniques to mechanically secure a first PCB to a second PCB in according to one or more techniques of this disclosure. Antennae 100D-100F depict portions of antenna 100 and 120 described above in relation to FIGS. 1A and 1B.

Antenna 100D in the top-view example of FIG. 4A depicts radiating slots 104 and vias 110 that are shown arranged in the X-direction. Coupling slots 106 are arranged in the Y-direction. Antenna 100D depicts the portion of antenna 120 where a first PCB, e.g. PCB 422 connects to a second PCB, i.e. PCB 424. PCB 422 and PCB 424 are examples of PCB 122 and PCB 124 described above in relation to FIG. 1B. Antenna 100D may include mechanical fasteners that pass through existing vias 110 and secure PCB 422 to PCB 424.

FIG. 4B depicts a top-view of antenna 100E with a portion of feed waveguide 350 arranged in the Y-direction such that feed waveguide 350 is arranged to cover coupling slots 106. Antenna 100E also includes mechanical fasteners that pass through existing vias 110 to mechanically connect waveguide 350 to antenna 100B. Antenna 100E may also include a second set of mechanical fasteners 408 that pass through the existing vias 110 along the X-direction between PCB 422 and PCB 424 to secure PCB 422 to PCB 424.

Antenna 100E may also include a third set of fasteners 412 used to secure PCB 422 to PCB 424. In the example of FIG. 4B, the third set of fasteners 412 is depicted in the X-Y plane along the X-direction. In other words, the third set of fasteners 412 may be aligned parallel to the radiating slot layer and configured to mechanically secure the first PCB to the second PCB. The third set of fasteners 412 may form a stitch pattern, similar to stitching fabric together. In some examples, the third set of fasteners 412 may be formed by a series of pins, a length of wire, or a length of other material such that the third set of fasteners 412 provides mechanical support without interfering with the function of antenna 100E. In this manner, the structural support from waveguide 350, fasteners 308, 408 and 412 may provide additional mechanical support for a slot array antenna of this disclosure to withstand mechanical stress and provide reliable performance over time. The addition of fasteners 308, 408 and 412 may also be less expensive and add little additional mass to a PCB based slot array antenna when compared to other techniques. Also, because the fasteners of this disclosure are arranged along the antenna centerline, e.g. along waveguide 350, the mass from the fasteners may have little impact on the moment mass of the slot array antenna which may provide mechanical strength without impacting the aiming performance of the antenna.

FIG. 4C depicts a side cutaway view of antenna 100F and waveguide 350. Mechanical fasteners 306, such as pins, pass through existing vias 110 to secure waveguide 350 to antenna 100C. Antenna 100F also depicts the second set of fasteners 408, which correspond to the second set of fasteners 408 described above in relation to FIG. 4B. In the example of FIG. 4C, the second set of fasteners 408 are depicted as U-shaped pins or staples arranged in the Z-direction to pass through existing vias 110. In other examples the second set of fasteners 408 may be formed by straight pins, or other shapes, or may form a stitching pattern similar to the stitching pattern of the third set of fasteners 412 described above in relation to FIG. 4B.

Figure 5:
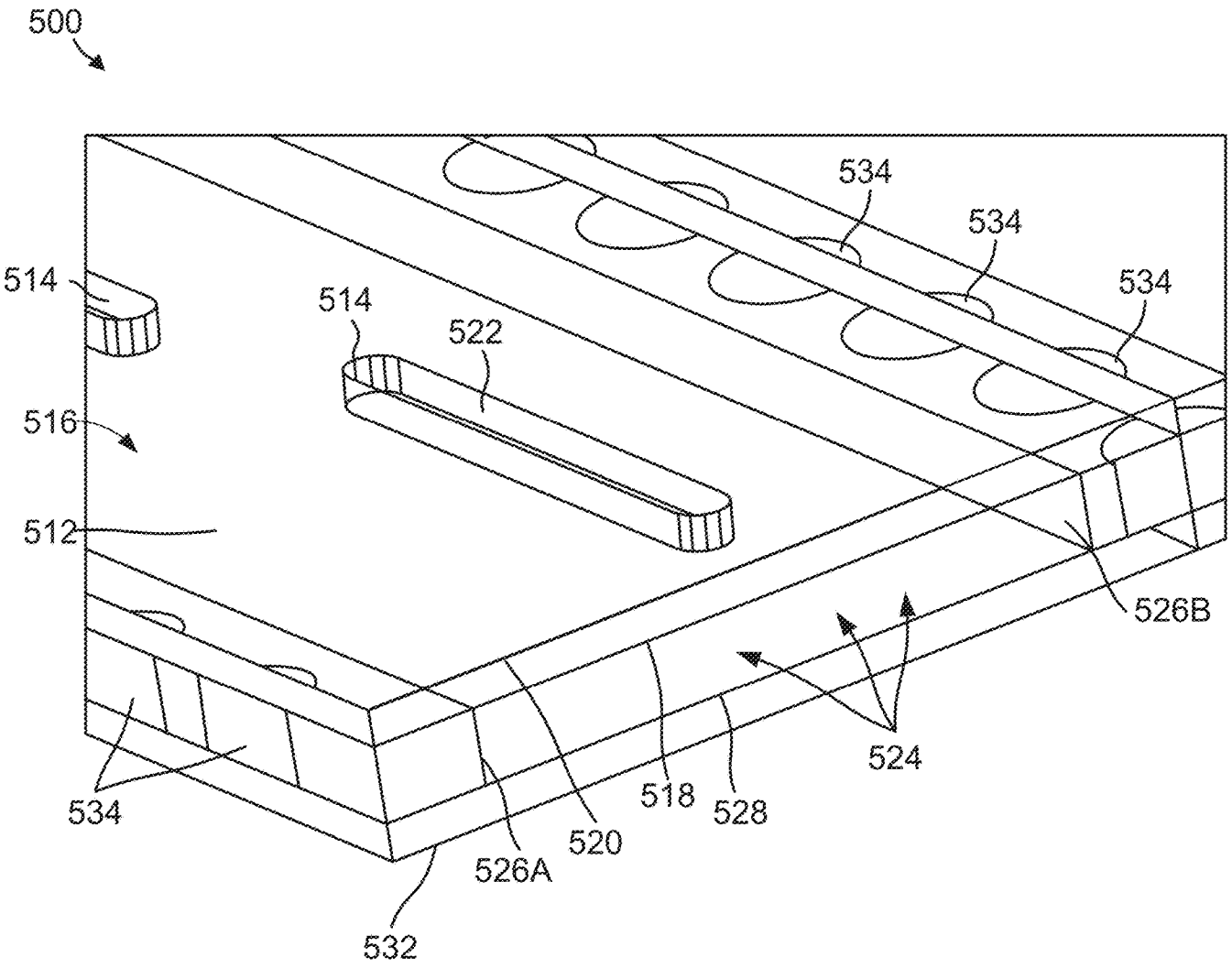
FIG. 5 is a diagram illustrating a portion of a slot antenna with a conducing path that uses a gas rather than SIW in accordance with one or more techniques of this disclosure.

FIG. 5 is a diagram illustrating a portion of a slot antenna with a conducing path that uses a gas rather than SIW in accordance with one or more techniques of this disclosure. Antenna 500 of FIG. 5 is an example of slot array antenna 100 described above in relation to FIG. 1A.

Antenna 500 may be fabricated using multi-layer circuit board techniques and may include two or more PCBs fastened together, similar to PCB 122 and PCB 124 described above in relation to FIG. 1B. Antenna 500 may include one or more sets of fasteners, configured to mechanically secure the first PCB to any other PCBs in antenna 500, similar to the fasteners described above in relation to FIGS. 3A-4C.

FIG. 5 illustrates a sample radiating waveguide comprising electrically conductive surfaces forming an RF conducting path 24 where the RF energy travels through air, or some other gas. In some examples a slot array antenna, according to the techniques of this disclosure may be used in a mechanical scanning, pulse modulation application, such as a mechanically steered weather radar antenna, such as may be used on an aircraft. In other examples, the slot array antenna of this disclosure may be used as a traveling wave antenna that may be steered electronically.

Antenna 500 includes a radiating slot plane 512, radiating waveguide layer with walls 526A and 526B and conducting path 524, and coupling slot plane 532. Coupling slot plane 532 may also be referred to as a feed plane in this disclosure and is an example of coupling slot plane 232 described above in relation to FIGS. 2A and 2B. Antenna 500 is configured to transmit RF energy from the radiating slots 514 in the radiating layer. Antenna 500 also captures the received radar signal that impinges on the radiating slot plane from the reflected radar transmit beam.

Radiating slot plane 512 includes radiating slots 514 in a radiating slot array on a PCB, which includes an outer or first plated layer 516, an inner or second plated layer 518 and a substrate layer 520. Each radiating slot 14 includes a plated interior surface 522. The plated interior surface 522 of the radiating slots in the radiating slot array extends from the outer plated layer 516 to the inner plated layer 518 through the substrate layer 520. The plated interior surface 522 of each slot 514 of the radiating slot array is conductive and electrically connects the outer plated layer 516 to the inner plated layer 518.

Substrate layer 520 may include materials used in PCB manufacturing, such as any of the various types of FR4, polyimide-based substrates, epoxy-based or similar substrates. Fiberglass based substrates, such as FR4, may have advantages over other types of substrates in a some antenna application because of strength, light weight, ability to withstand shock, and wide temperature operating range.

Each radiating waveguide in the radiating waveguide layer includes an RF energy conducting path 524, which may be enclosed by a first wall 526A and a second wall 526B. In some examples, the walls, 526A and 526B may include a substrate material, similar to that in substrate layer 520, which may be plated with a conductive material. Walls 526A and 26B may also include vias 534. In some examples, walls 526A and 526B may not be plated with a conductive material. Instead, the interior surface of vias 534 may be plated with a conductive material and act as a wall for RF conducting path 524, similar to an SIW wall. The conductive plating material of walls 526, vias 534 and plated interior surface 522 may be the same material as plated layers 516, 518 and 528. Some examples may include aluminum, copper, or some other conductive alloy or material that may be used in PCB fabrication.

The RF energy conducting path 524 is filled with some type of gas, such as air. When compared to an SIW radar antenna, a radar antenna with the conducting path 524 filled with a gas may have a lower insertion loss than an SIW radar antenna.

The coupling slot plane 532 includes an inner plated layer 528, which may be described as the third plated layer 528, in this disclosure. Inner plated layer 528 forms the fourth side, or plated layer, of conducting path 524. In other words, conducting path 524 is filled with a gas and includes four conductive surfaces: the second, or inner plated layer 518 of the radiating slot plane 512, the third or inner plated layer 528 of the coupling slot plane 532 and walls 526A and 526B. The first wall 526A, the second wall 526B, the second plated layer 518 and the third plated layer 528 are made from an electrically conductive material and are electrically connected to each other and electrically connected to the first plated layer 516 of the radiating slot plane 512. In some examples, antenna 500 may also include a termination edge, similar to termination edge 108 described above in relation to FIG. 1A (not shown in FIG. 5).

Figure 6:
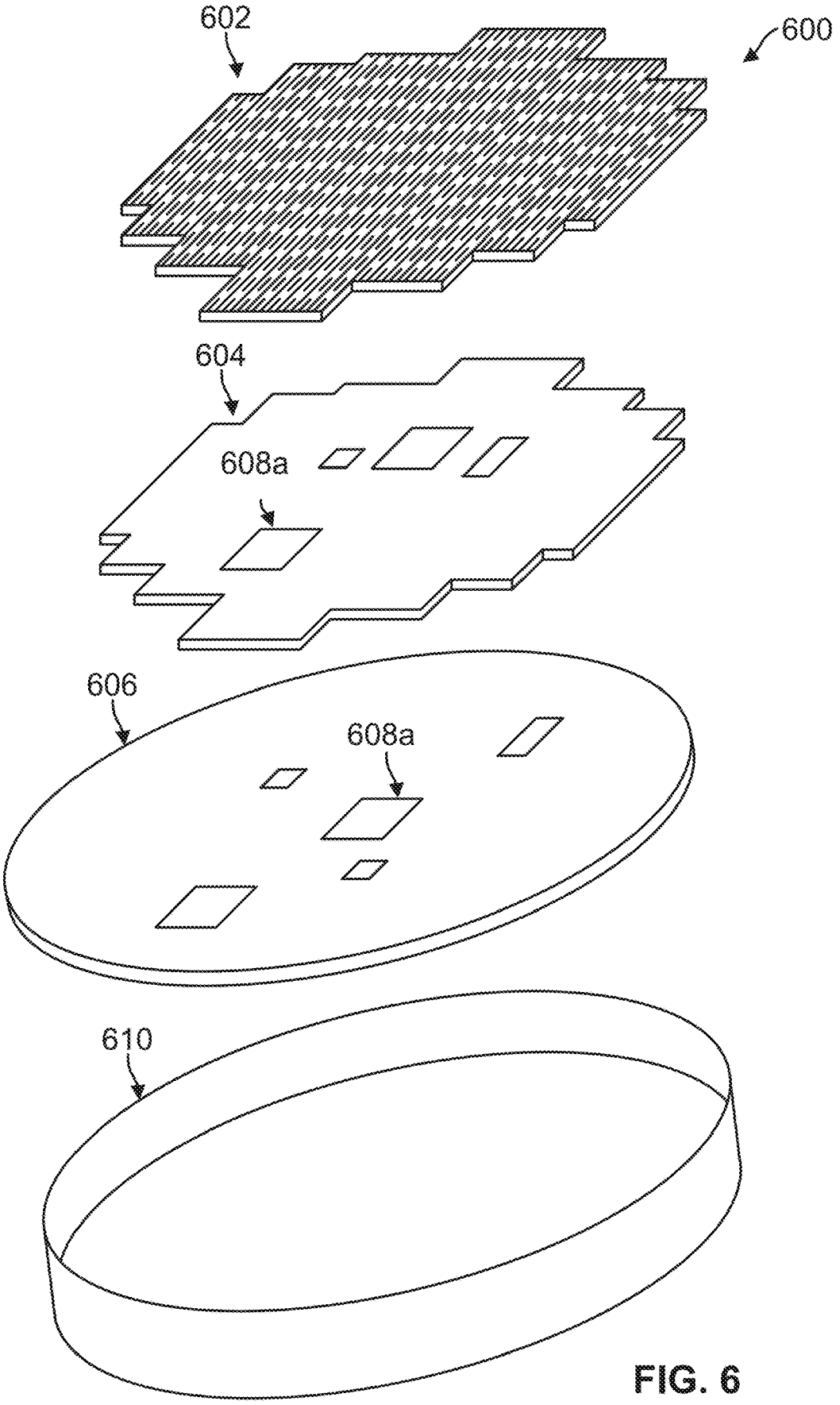
FIG. 6 is a conceptual diagram illustrating an exploded view of example integrated antenna system in accordance with one or more techniques of this disclosure.

FIG. 6 is a conceptual diagram illustrating an exploded view of example integrated antenna system in accordance with one or more techniques of this disclosure. Integrated antenna system 600 may attach to a motorized, gimbaled mount.

Integrated antenna system 600 may include one or more multi-layer PCBs that includes one or more antenna layers 602, one or more ground layers, one or more circuit signal path layers and one or more circuit layers with components, 604 and 206. The term printed wiring board (PWB) may be used interchangeably with PCB in this disclosure. Integrated antenna system 600 may also include a protective shield 210.

In some examples antenna layer 602 may be constructed of copper clad PCB for an upper and lower waveguide surface, with the dielectric of the PCB for the waveguide volume and plated vias (aka holes) for the waveguide walls, i.e. an SIW antenna. In other examples antenna layer 602 may include an RF conducting path filled with air, similar to antenna 500 described above in relation to FIG. 5.

The radiating waveguide structure beneath each row of radiating slots may include feed slots that couple the RF energy from the radar transmitter electronics to the radiating waveguides and further to the radiating slots. The same feed slots may couple the reflected RF energy received by antenna layer 602 to the radar receiver electronics. The feed slots of antenna system 600 may be similar to the coupling slots described above in relation to FIGS. 1A-4C. Each radiating waveguide may also include a terminal edge at each end to contain the RF energy as described above in relation to FIG. 1A.

As described above in relation to FIGS. 1A-4D, integrated antenna system 600 may include a support structure and a plurality of pins or other fasteners. The fasteners may pass through existing vias of integrated antenna system 600 as well as through the support structure. The fasteners may mechanically secure the support structure to the integrated radar antenna system 600. In some examples the support structure may include protective shield 610.

In some examples integrated antenna system 600 may be fabricated from one or more multi-layer PCBs, similar to PCB 122 and PCB 124 described above in relation to FIG. 1B. Integrated antenna system 600 may also include additional fasteners configured to secure the one multi-layer PCB to the other multi-layer PCBs as described above in relation to FIGS. 4A-4C.

The multi-layer printed circuit board may include circuit layers 604 and 606 containing circuits and components that implement radar transmitter electronics, radar receiver electronics, one or more processors 608A and 608B, communication electronics, power conditioning and distribution, clock/timers and other circuitry and components. Radar receiver electronics may include a homodyne receiver to directly convert RF signals to a baseband frequency. The one or more processors 608A and 608B may be configured to control the radar transmit electronics and radar receive electronics as well as process and identify radar targets and send notifications and information to the weather radar display. Processors 608A and 608B may also be configured to determine an aim direction for the integrated radar antenna 600 and send the antenna position signal to the gimbaled mount to aim the antenna.

One or more processors 608A and 608B may include any one or more of a microprocessor, a controller, a digital signal processor (DSP), an application specific integrated circuit (ASIC), a field-programmable gate array (FPGA), a system on chip (SoC) or equivalent discrete or integrated logic circuitry. A processor may be integrated circuitry, i.e., integrated processing circuitry, and that the integrated processing circuitry may be realized as fixed hardware processing circuitry, programmable processing circuitry and/or a combination of both fixed and programmable processing circuitry. Circuit layers 604 and 606 may include one or more ground layers, power supply layers, as well as spacing, shielding traces and other features required for RF circuit design.

Antenna layer 602 may be electrically connected to circuit paths and components on one or more circuit layers 604 and 606. In some examples, plated vias may provide connections between one or more circuit layers 604 and 606, as well as to antenna layer 602. A via may be a plated or unplated hole that may be drilled, etched or otherwise formed between layers of the multi-layer PCB. A plated via may be plated with a conductive material to electrically connect layers. Some examples of conductive material may include copper, solder, conductive epoxy or other materials. Antenna layer 602 may also include one or more transitions to connect the waveguide to the one or more circuit layers 604 and 606.

Protective shield 610 may cover and provide structural support and protection for integrated radar antenna 600, which may include protection from moisture or other contaminants. Protective shield 610 may be a molded plastic, stamped or formed sheet metal or other suitable material. Protective shield 610 may include a conductive coating in one or more areas to provide shielding for electromagnetic interference (EMI) as well as RF isolation and impedance control. Protective shield 610 may include penetrations for power, communication or other connections as well as be configured to securely mount to the gimbaled mount (not shown in FIG. 6). Protective shield 610 may include one or more mechanical stiffener structures for additional strength. Protective shield 610 may provide added strength as well as other multiple functions, such as EMI shielding, heat dissipation (heat sink) in addition to adding structural integrity for vibration and shock.

Various examples of the disclosure have been described. These and other examples are within the scope of the following claims.

The invention claimed is:

1. A slotted array antenna device, the device comprising:
- a radiating slot plane comprising a radiating slot array including a plurality of radiating slots;
- a radiating waveguide comprising:
  - a plurality of vias arranged to form the radiating waveguide; and
  - a coupling slot, wherein the coupling slot is arranged in a coupling slot layer on an opposite side of the device from the radiating slot plane, wherein the radiating waveguide is configured to conduct radio frequency (RF) energy between the coupling slot and the one or more of the radiating slots of the radiating slot array;
- a feed waveguide, wherein:
  - the feed waveguide is configured to conduct RF energy to the coupling slot, and
  - the feed waveguide is configured to provide structural support to the device; and
- a first plurality of pins, wherein each pin of the first plurality of pins:
  - passes through a via of the plurality of vias, and
  - passes through the feed waveguide,
  - such that the first plurality of pins mechanically secure the feed waveguide to the coupling slot layer of the device;
- a second plurality of pins; and
- a first printed circuit board (PCB) and a second PCB, wherein:
  - the radiating slot plane comprises a first radiating slot plane on the first PCB and a second radiating slot plane on the second PCB;
- the coupling slot layer comprises a first coupling slot layer on the first PCB and a second coupling slot layer on the second PCB;
  - the radiating waveguide comprises a first radiating waveguide section on the first PCB and a second radiating waveguide section on the second PCB; and
  - each pin of the second plurality of pins passes through a via of the plurality of vias, such that the second plurality of pins mechanically secure the first PCB to the second PCB.

2. The device of claim 1, wherein the device further comprises a plurality of fasteners aligned parallel to the radiating slot plane and configured to mechanically secure the first PCB to the second PCB.

3. The device of claim 1, wherein the radiating waveguide is a substrate integrated waveguide (SIW).

4. The device of claim 1,
- wherein the radiating slot plane comprises:
  - a printed circuit board (PCB) comprising a first plated layer, a second plated layer, and a substrate layer, wherein each slot of the radiating slot array includes an interior surface, wherein:
    - the interior surface of each slot extends from the first plated layer to the second plated layer through the substrate layer,
    - the interior surface of each slot comprises a conductive plated material, wherein the conductive plated material electrically connects the first plated layer to the second plated layer;
- wherein the radiating waveguide comprises:
  - a RF conducting path, wherein the RF conducting path of the radiating waveguide comprises a gas;
  - a third plated layer; and
  - the second plated layer, wherein:
    - the second plated layer and the third plated layer comprise a conductive material, the second plated layer is electrically connected to the third plated layer and is electrically connected to the first plated layer of the radiating slot plane;

the third plated layer is electrically connected to the first plated layer of the radiating slot plane.

5. A weather radar system comprising an integrated radar antenna, the integrated radar antenna comprising a multi-layer circuit board, the multi-layer circuit board comprising:

radar transmitter electronics in signal communication with the slotted array waveguide antenna, wherein the radar transmitter electronics, in conjunction with the slotted array waveguide antenna, are configured to output radar signals;

radar receiver electronics in signal communication with the slotted array waveguide antenna, wherein the radar receiver electronics are configured to receive from the slotted array waveguide antenna radar reflections corresponding to the outputted radar signals; and a slotted array antenna, comprising:

a radiating slot plane comprising a radiating slot array including a plurality of radiating slots;

a radiating waveguide comprising:

a plurality of vias arranged to form the radiating waveguide; and a coupling slot, wherein the coupling slot is arranged in a coupling slot layer on an opposite side of the device from the radiating slot plane, wherein the radiating waveguide is configured to conduct radio frequency (RF) energy from the coupling slot to one or more of the radiating slots of the radiating slot array;

a support structure, configured to provide structural support to the slotted array antenna:

a first plurality of pins, wherein each pin of the first plurality of pins:

passes through a via of the plurality of vias, and passes through the support structure, such that the first plurality of pins mechanically secure the support structure to the integrated radar antenna;

a first printed circuit board (PCB) and a second PCB, wherein:

the radiating slot plane comprises a first radiating slot plane on the first PCB and a second radiating slot plane on the second PCB;

the coupling slot layer comprises a first coupling slot layer on the first PCB and a second coupling slot layer on the second PCB; the radiating waveguide comprises a first radiating waveguide section on the first PCB and a second radiating waveguide section on the second PCB;

a second plurality of pins, wherein each pin of the second plurality of pins passes through a via of the plurality of vias, such that the second plurality of pins mechanically secure the first PCB to the second PCB.

6. The weather radar system of claim 5, further comprising a gimbaled mount, wherein the gimbaled mount is configured to:

support the integrated radar antenna;

receive an antenna position signal;

aim the integrated radar antenna in response to the antenna position signal.

7. The weather radar system of claim 6, further comprising one or more processors configured to:

determine an aim direction for the integrated radar antenna at a first time; and send the antenna position signal to the gimbaled mount.

8. The weather radar system of claim 5, wherein the weather radar system is configured to mount to an aircraft.

9. The weather radar system of claim 5, wherein the weather radar system is configured to send weather information to a weather display device.

10. The weather radar system of claim 5, wherein the integrated radar antenna further comprises one or more processors.

11. The weather radar system of claim 5, further comprising a protective shield, wherein the protective shield is configured to support, protect and provide an electromagnetic interference (EMI) shield for the integrated radar antenna.

* * * * *